United States Patent [19]

Smeets

[11] 4,391,174

[45] Jul. 5, 1983

[54] PUNCH PRESS MACHINE WITH ADJUSTABLE TOOL POSITIONING

[76] Inventor: Gerard G. F. Smeets, 50 Inverlochy Blvd., Apt. 102, Thornhill, Ontario, Canada

[21] Appl. No.: 72,668

[22] Filed: Sep. 5, 1979

[30] Foreign Application Priority Data

Aug. 30, 1978 [CA] Canada ..... 310359

[51] Int. Cl.[3] ..... B21D 28/26; B26F 1/04

[52] U.S. Cl. ..... 83/552; 83/561; 83/640; 83/641

[58] Field of Search ..... 83/552, 561, 640, 641

[56] References Cited

U.S. PATENT DOCUMENTS 3,527,130 9/1970 Knehans ..... 83/552 X 3,853,029 12/1974 Todd ..... 83/552

3,938,416 2/1976 Beauplat ..... 83/552

*Primary Examiner*—Donald R. Schran

[57] ABSTRACT

A turret type punch press machine, adjustable means for aligning tool elements of spaced rotors comprising, a supporting member for at least one of the rotors, the supporting member being pivottably connected to a main frame of the machine, adjustable positioning and locking means for providing limited vernier adjustment of said supporting member about its pivot point on the machine, an indexing mechanism mounted on the supporting member providing for multi-position indexing of the rotor about its axis, and wherein the indexing mechanism is adjustable to provide limited angular positioning of the rotor for each indexed position thereof and to provide, in conjunction with the adjustable positioning of the supporting member two limited and substantial orthogonal directions of adjustment of the position of a tool mounted in the rotor on the supporting member.

8 Claims, 2 Drawing Figures

PUNCH PRESS MACHINE WITH ADJUSTABLE TOOL POSITIONING

FIELD OF THE INVENTION

This invention related to punch press machines and means for adjusting the alignment of the punching tools especially in multi-tool machines of the turret type and will be described with reference thereto.

DESCRIPTION OF THE PRIOR ART

An inherent difficulty with the set-up of punch press machines of the turret type is the proper alignment of the punching tools, i.e. punch and die elements, for proper operation thereof.

There are two types of alignments necessary, first the axial alignment of the upper and lower rotors, here we assume that the rotors are accurately mated, and the angular or rotational positioning of each rotor so that the punch and die elements are accurately aligned with each other and with the ram of the machine. Indexing systems have been employed wherein a stop member cooperates with positioning pins located on the periphery of the rotor, a positioning pin being provided for each tool to be positioned. The pins are normally of the eccentric type which can be rotationally adjusted for relatively accurate individual positioning of each tool at the working position of the machine. However, accurate axial alignment was very difficult since no readily adjustable system was yet available.

SUMMARY OF THE INVENTION

It is the object of the present invention to overcome the difficulties met with in alignment of tools in known punch press machines by providing an adjustment system allowing for accurate position adjustment of tools in two directions substantially at right angles to each other at the working station of a punch press machine.

According to the present invention at least one of the working tool element holders, such as a turret rotor, is supported to be adjustable in two directions substantially at right angles to each other. The rotor supporting mechanism is preferrably in the form of a first supporting member pivoted to rotate about a fixed point on a punch press machine frame thus providing adjustment of the supporting member along an arc about the fixed pivot point. The tool, for instance a die, is supported in turn by a tool holding member, preferrably a turret member, is rotatable about a fixed point on the first supporting member. Adjustable stop or positioning means an indexing system is provided for the tool holding member. The indexing system, which forms part of the invention, comprises an indexing pin assocated with each tool unit position. Preferrably the arc of travel of a tool in the tool holding member about its pivot crosses the arc of the rotation of the first supporting member about its pivot at substantially right angles at the working station of the machine. The adjustment provided in two orthogonal directions allows for accurate positioning of a tool at the working station.

A further feature of the invention is the unsymmetrical angular displacement of tool elements in the rotors rather than the symmetrical as normally employed. Unsymmetrical displacement is used to provide a maximum number of tool unit positions in a rotor.

BRIEF DESCRIPTION OF THE DRAWINGS

The invention will now be more fully described with reference to the figures of the drawings in which.

DESCRIPTION OF THE INVENTION

Figure 1:
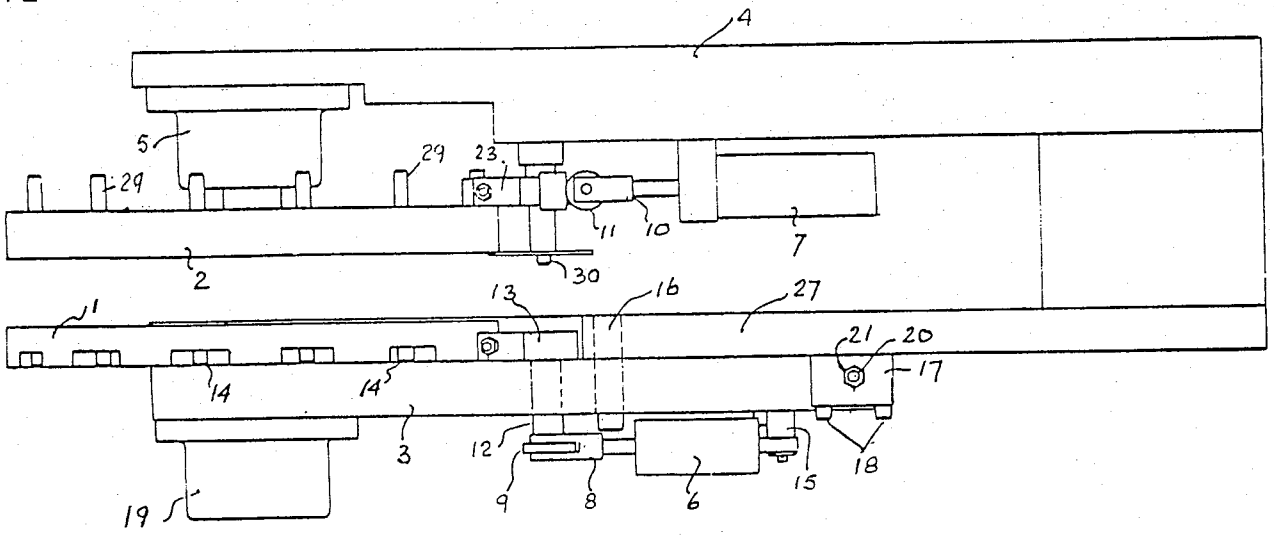
FIG. 1 is a simplified vertical view of the working area of a turret type punch press machine incorporating the invention and, FIG. 2 is a plan view of the lower turret rotor of the machine of FIG. 1 showing greater detail of the positioning mechanism according to the invention.
Figure 2:
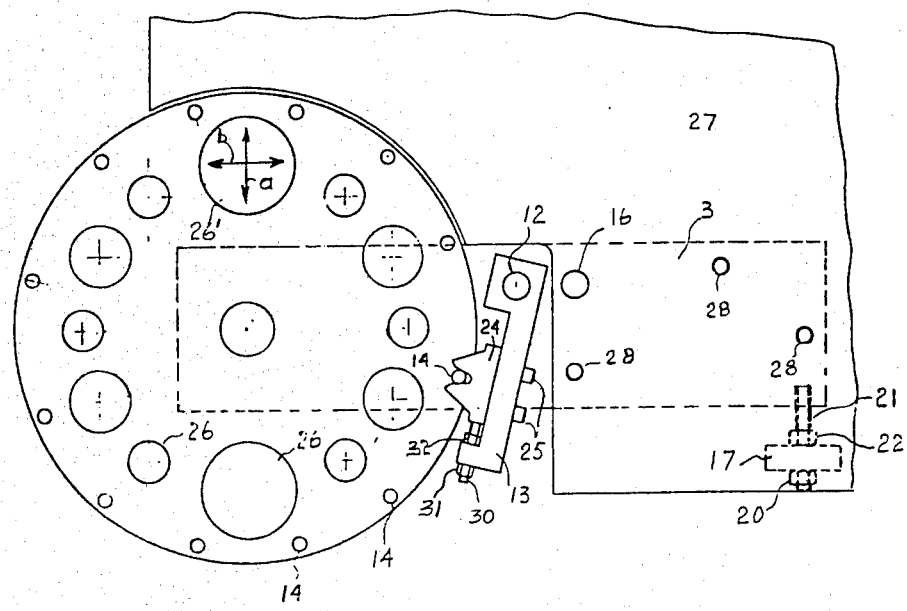

FIGS. 1 and 2 show a drawing of a portion of a punch press machine which incorporates the mechanism according to the invention. The machine comprises a main frame member 27 of which overhaning member 4, supporting a turret rotor 2 may be an integral part. A lower turret rotor 1 is supported by a member 3, which when positioned accurately as will be described subsequently, is secured to main frame 27 by means of bolts 28.

Upper rotor 2 is suspended from member 4 by a driving and support member 5. Lower rotor 1 is supported and driven by a similar unit 19. Rotation of rotors 1 and 2 is, of course, synchronized as is well known in the art.

The final positioning of the rotors 1 and 2 are controlled by indexing systems comprising for rotor 1, indexing pins 14 and indexing detent 24 supported for rotation, about shaft 12, by an arm 13. Arm 13 rotates detent 14 to or away from pins 14 under control of a hydraulic piston 6 and mechanical connections comprising a clevised piston rod 8 secured to an arm 19 fixed on the lower end of shaft 12.

In a similar manner a detent 23, rotatable about a shaft 30 cooperates with indexing pins 29 of rotor 2 to fix the final position of rotor 2. A hydraulic piston 7, clevised piston rod 10 and roller 11 operate detent 30 to and away from indexing pins 29.

The features of the present invention will now be described with particular reference to FIG. 2 which shows those features most clearly.

In order to ensure proper operation of a punch press machine the punch and die units, at the working station of the machine, must be properly aligned. In a multi unit machine such as the turret type it is necessary to ensure that the axis of the punch and die elements are aligned at the working station. Two directions of an adjustment are provided according to the present inventions.

Supporting member 3, for rotor 1, is pivoted about pin 16 fixed to frame 27 and by means of an adjustment mechanism comprised by parts 17, 18, 20, 21, and 22, some of which are shown in dotted outline since, in this instance, supporting member 3 and the adjustment therefor and secured below main frame 27. Part 17 is a block fixed to main frame 27 and through which an adjustment bolt 21 passes. Bolt 21 is provided with nuts 20 and 22 so that bolt 21 may be longitudinally adjusted in block 17. The end of bolt 21, remote from block 17, is connected to supporting member 3. It will be obvious that member 3 may be rotated about pin 16 by adjustment of the position of the nuts 20, 22 on bolt 21. The consequent movement of a die support aperture 26' at the working station is indicated by arc a.

Coarse angular position of aperture 26' is adjusted by movement of detent 24 longitudinally of arm 13 by means of adjustment bolt 30 and nuts 31, 32. This adjustment should be performed with all eccentric bolts 14 at a central position of adjustment. Fine rotational adjustment for each individual die support aperture is provided for bolts 14.

When the adjustment is complete, bolts 28 are tightened to secure supporting member 3 to the frame in that adjusted position and screws 25 tightened to secure detent 24 to its adjusted position on arm 13.

What I claim as new and desire to secure by Letters Patent of the United States is:

1. In a turret type punch press machine, adjustable means for aligning tool elements of spaced rotors comprising, a supporting member for at least one of the rotors, the supporting member being pivottably connected to a main frame of the machine, adjustable positioning and locking means for providing limited vernier adjustment of said supporting member about its pivot point on the machine, an indexing mechanism mounted on the supporting member providing for multi-position indexing of the rotor about its axis, and wherein the indexing mechanism is adjustable to provide limited angular positioning of the rotor for each indexed position thereof and to provide, in conjunction with the adjustable positioning of the supporting member two limited and substantial orthogonal directions of adjustment of the position of a tool mounted in the rotor on the supporting member.

2. A machine as claimed in claim 1 wherein the position of a detent of the indexing mechanism for the rotor is adjustable in the direction of the circumference of that rotor.

3. A machine as claimed in claim 1 wherein an eccentrically adjustable, rotor mounted, indexing pin is associated with each indexed position of the rotor.

4. A machine as claimed in claim 2 wherein an eccentrically adjustable, rotor mounted, indexing pin is associated with each indexed position of the rotor.

5. A machine as claimed in claims 1, 3 or 4 wherein the indexed positions are unsymmetrically located about the rotor in order that a maximum number of positions are provided for tools of different sizes.

6. In a turret type punch press machine, a main frame member, first and second turret rotors adapted to carry mating elements of tool units into substantial alignment at a working station of the machines, means for adjusting the said alignment comprising, at least one support member supporting one of the rotors for limited vernier adjustment about a pivot point on the main frame, an indexing mechanism for indexing tool units consecutively to the working station, the indexing mechanism including a detent, mounted on the support member, cooperating with index means mounted near the periphery of the rotor, and wherein the detent is adjustable in the direction of the periphery of the rotor to provide a direction of adjustment of the position of a tool at the working station along an arc which crosses the arc of movement of the tool when the support member is adjusted about said pivot.

7. A machine as claimed in claim 6 wherein the index means on the rotor comprises an eccentrically adjustable pin associated with each tool provided for in the rotor.

8. A machine as claimed in claim 6 or 7 wherein the tool positions on the rotors are unsymmetrically located about the periphery of the rotor.

* * * * *